US006315700B1

(12) United States Patent
Shifferaw

(10) Patent No.: US 6,315,700 B1
(45) Date of Patent: Nov. 13, 2001

(54) AIR RESISTANCE EXERCISE WINGS

(76) Inventor: Tessema Dosho Shifferaw, 3000 Giant Hwy., San Pablo, CA (US) 94806-1017

( * ) Notice: Subject to any disclaimer, the term of this patent is extended or adjusted under 35 U.S.C. 154(b) by 0 days.

(21) Appl. No.: 09/059,639

(22) Filed: Apr. 13, 1998

(51) Int. Cl.[7] ..... A63B 21/00

(52) U.S. Cl. ..... 482/111; 441/55; 441/56; 441/58; 441/59

(58) Field of Search ..... 16/323, 324, 326; 482/105, 111; 441/55, 56, 57, 58, 59; 446/473, 216, 215, 213

(56) References Cited

U.S. PATENT DOCUMENTS

Re. 16,671 * 7/1927 Walters ..... 16/324
2,919,919 * 1/1960 Ebb ..... 482/82
3,097,375 * 7/1963 Griffith ..... 441/57
3,529,313 * 9/1970 Girden ..... 441/58
4,858,916 * 8/1989 Beaumont ..... 272/119
4,923,418 * 5/1990 Hoffman ..... 441/57
5,304,080 * 4/1994 Dilger ..... 441/58
5,378,217 * 1/1995 D'Orta ..... 482/111
5,658,224 * 8/1997 Betrock ..... 482/55

* cited by examiner

*Primary Examiner*—Mickey Yu
*Assistant Examiner*—Tam Nguyen
(74) *Attorney, Agent, or Firm*—Flehr Hohbach Test Albritton & Herbert LLP

(57) ABSTRACT

Exercise wings which utilize air resistance to intensify aerobic workouts. The wings are worn on the arms of the exerciser and have major surfaces for displacing air and thereby resisting movement of the arms. In the disclosed embodiment, each of the wings is formed in two sections which can be extended for use and folded together for transportation and storage.

14 Claims, 4 Drawing Sheets

AIR RESISTANCE EXERCISE WINGS

This invention pertains generally to exercise equipment and, more particularly, to apparatus and equipment which are particularly suitable for use in aerobic exercise.

In recent years, people have become increasingly aware of the benefits of aerobic exercise for increasing energy, burning fat and strengthening the cardiovascular system. Such exercise can also reduce blood pressure and cholesterol levels, as well as stress, thereby reducing the risk of arteriosclerosis and heart disease.

Some forms of aerobic exercise such as walking, running and swimming can be performed without special equipment, although light weights are sometimes used during such exercise to increase the aerobic resistance. Other forms of aerobic exercise such as cycling and other machine assisted exercises require special equipment which can be quite elaborate and expensive.

High impact forms of exercise such as running can be damaging to the knees, hips and other joints of the body, whereas lower impact exercises may not provide the level of exercise desired without special equipment. Such equipment tends to be expensive and limited as to where it can be used, as well as requiring substantial floor space even when not in use.

It is in general an object of the invention to provide new and improved apparatus for use in aerobic exercise.

Another object of the invention is to provide apparatus of the above character which utilizes air resistance to increase the intensity of aerobic workouts.

These and other objects are achieved in accordance with the invention by providing a pair of wings which are worn on the arms of a person during exercise. The wings have major surfaces for displacing air thereby resisting movement of the arms. In the disclosed embodiment, the wings are formed in two sections which can be extended for use and folded together for transportation and storage.

Figure 1:
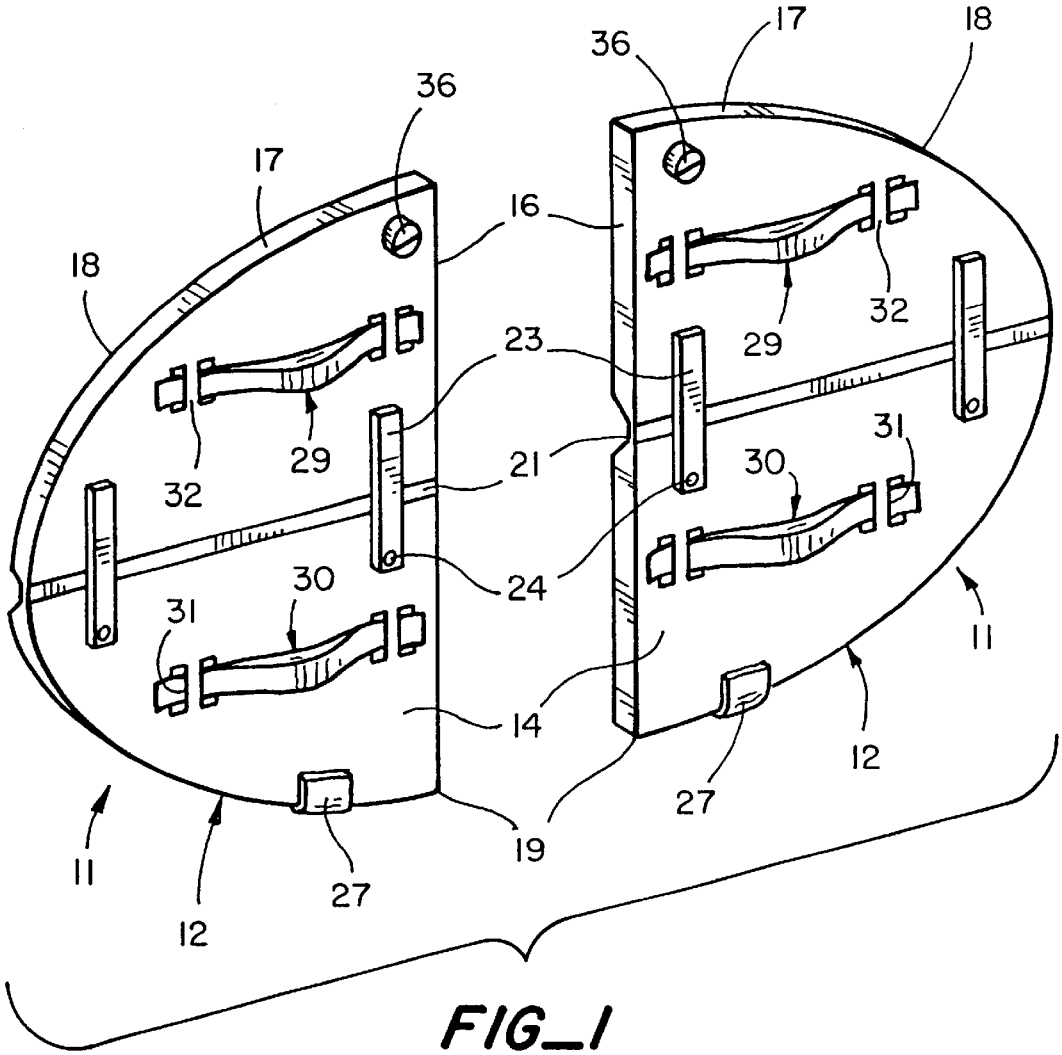
FIG. 1 is an isometric view of one embodiment of a pair of exercise wings according to the invention.
Figure 5:
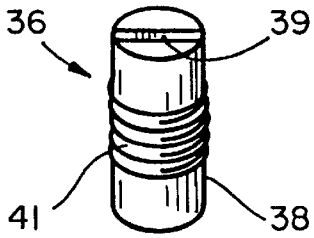
FIG. 5 is an isometric view of a whistle which is used in the embodiment of FIG. 1.
Figure 2:
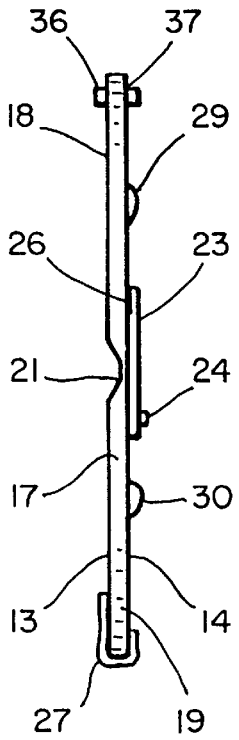
FIG. 2 is a left side elevational view of one of the exercise wings in the embodiment of FIG. 1.

As illustrated in the drawings, each of the exercise wings 11 has a generally planar body 12 with major surfaces 13, 14 on the front and rear sides thereof. The body is D-shaped, with a straight inner edge 16 and an arcuately curved outer edge 17. In the embodiment illustrated, the curvature of the outer edge is generally elliptical, with inner edge 16 lying along the minor axis of the ellipse.

Figure 3:
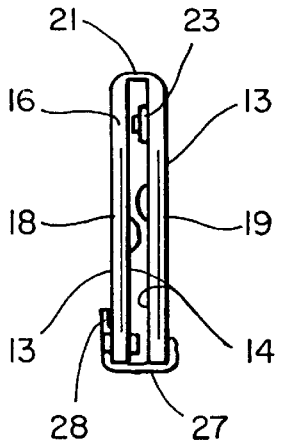
FIG. 3 is a right side elevational view of one of the exercise wings in the embodiment of FIG. 1, with the wing in a folded position.

The body is formed in two sections 18, 19 which are connected together by a hinge 21 for movement between the extended position shown in FIG. 1 and the folded position shown in FIG. 3. In the extended position, the two sections are positioned side-by-side, with the major surfaces of the two sections aligned in coplanar fashion. In the folded position, the two sections are superposed, with the rear surfaces of the two sections facing each other in spaced parallel relationship.

The body sections are fabricated of a relatively rigid material such as plastic or wood.

The two sections are held in the extended position by a pair of pivotally mounted lock bars 23 on the back sides of the sections. One end of each lock bar is mounted on a pin 24 on section 19 for movement about an axis perpendicular to the surface of the section, and the other end is secured to the surface of section 18 by a Velcro fastener 26 carried by the end portion of the bar and the surface of the section. When the Velcro fasteners are engaged, the lock bars provide a rigid connection between the two sections which retains them in the extended position. When the Velcro fasteners are disengaged, the lock bars can be rotated to a position parallel to the hinged edge of section 19, and the two sections can then be folded together, as illustrated in FIG. 3, with the back sides of the sections facing each other.

The sections are held in the folded position by a strap 27, one end of which is affixed to the front side of section 19 near outer edge 17. The other end of the strap is secured to the front side of section 18 by a Velcro fastener 28 on the end portion of the strap and the front surface of the section.

Means is provided for attaching the wings to the arms of an exerciser. This means includes a handle 29 which is adapted to be grasped by the hand, and a strap 30 for the forearm. The handle and the strap are fabricated of a flexible material such as webbing or cloth, and they are secured to the back sides of the body sections by Velcro fasteners 31. In the embodiment illustrated, the end portions of the handle and strap pass under bars 32 on the body sections, and the Velcro fasteners are located on the under sides of the bars.

The handle and arm strap are aligned along a line which is generally parallel to the inner edge 16 of the wing, with the strap being somewhat closer to the hinge than the handle so that the two clear each other when the two sections are folded over.

Figure 4:
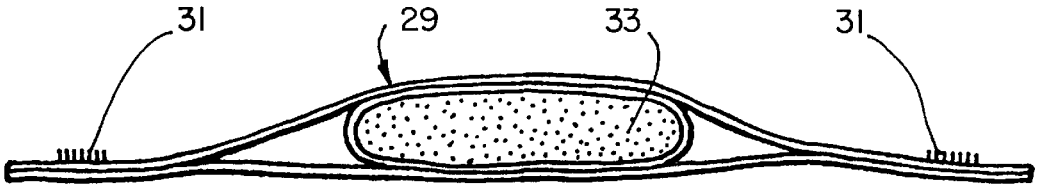
FIG. 4 is a cross sectional view of the handle of one of the exercise wings in the embodiment of FIG. 1.

As illustrated in FIG. 4, the handle is filled with a heavier material 33, such as sand or lead shot, in order to increase the gravitational resistance of the wing. If desired, the arm strap can be weighted in a similar material, and handles and straps with different weights can be used interchangeably to vary the resistance.

A whistle 36 is mounted on section 18 near outer edge 17 for emitting an audible tone upon movement of the wing through the air. The whistle is mounted in a bore hole 37 which extends trough the body, and is oriented along an axis generally perpendicular to the major surfaces. The whistle has a hollow cylindrical body 38 with slits 39 at both ends through which air is forced as the wing is moved in a direction perpendicular to its major surfaces. The pitch of the tone emitted by the whistle increases with the speed at which the wing is moved through the air, and with openings at both ends, a tone will be produced when the wing is moving in either direction. The whistle is retained in the wing by an external thread 41 which engages a corresponding thread in bore hole 37.

In operation and use, the wings are opened to their extended position and locked in that position by lock bars 23. The exerciser then slides his hands through arm straps 30 and grasps handles 29 with his hands so that the wings are flat against the forearms. For most exercises, the backs of the hands and forearms are against the wings, although the handles can also be grasped with the fronts of the hands and the forearms facing the wings, if desired.

As a person wearing the wings moves his arms in a direction perpendicular to the major surfaces of the wings, a substantial amount of air must be displaced by the wings. The amount of work required to displace the air is dependent largely upon the speed at which the wings are moved, and that speed can be monitored at least to some extent by the pitch of the tone emitted by the whistles.

Figure 6:
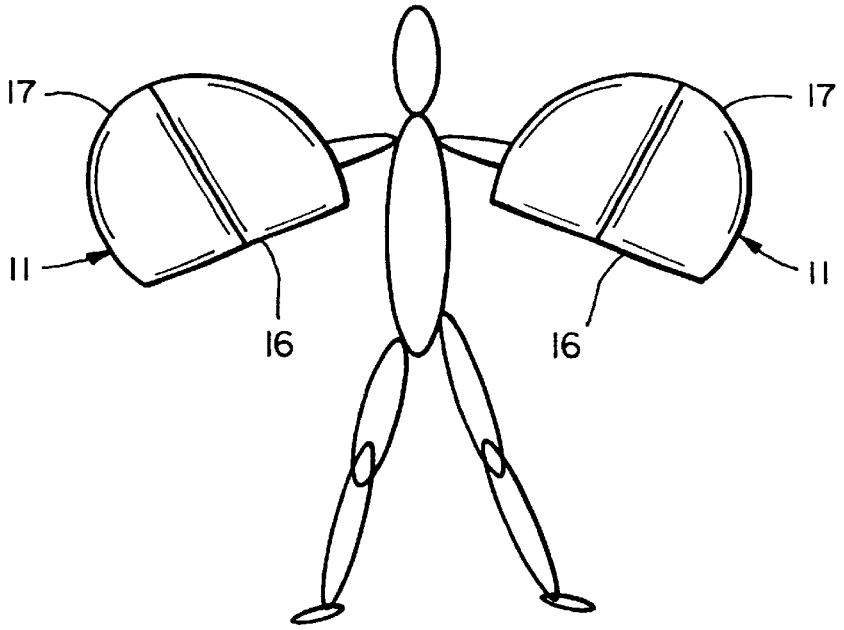
FIGS. 6–9 are isometric views, somewhat schematic, illustrating the exercise wings in use.
Figure 7:
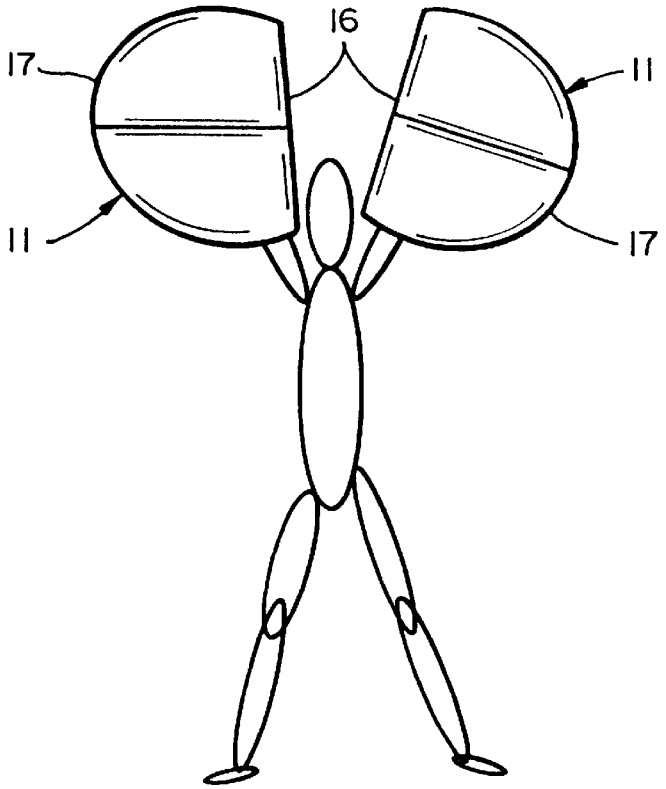
Figure 8:
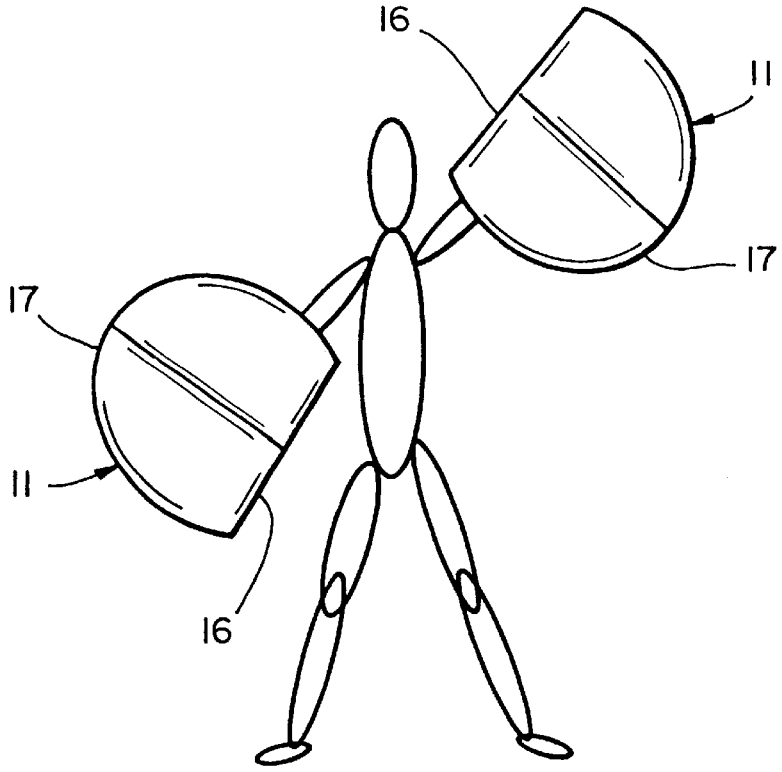
Figure 9:
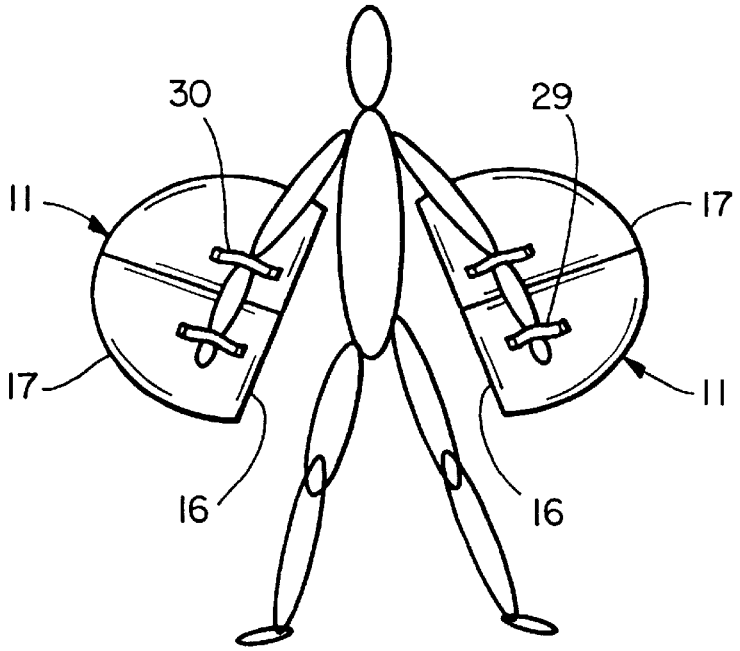

Examples of the types of exercises which can be done with the wings are illustrated in FIGS. 6–9. FIG. 6 shows how they can be used for exercises such as abdominal twisting and chest fly workouts. FIG. 7 shows them in use for bilateral up and down movement to exercise the shoulders, and FIG. 8 illustrates a unilateral up and down movement. FIG. 9 shows them in use for a push and curl exercise for the fronts and backs of the arms.

For transportation and storage, the wings can be folded over, with the two body sections facing each other. They are secured in that position by straps 27.

The wings can be used for almost any aerobic exercise where the arms are free. They can be used to intensify workouts such as walking, running or simply standing in place and twisting the arms about. The resistance which they provide will exercise not only the arms, but also the shoulders, neck, chest and abdomen. The resistance is very smooth and non-jerking, and is particularly beneficial for people who have joint problems or cannot use weights in aerobic exercise because the inertia of the weights might be injurious to them.

As can be seen in FIGS. 6–9, the D-shape of the wings is particularly advantageous in that the straight edges 16 allow the arms to move freely with the wings close to the body without interference between the wings and the body.

It is apparent from the foregoing that a new and improved exercise wing has been provided. While only certain presently preferred embodiments have been described in detail, as will be apparent to those familiar with the art, certain changes and modifications can be made without departing from the scope of the invention as defined by the following claims.

What is claimed is:

1. An exercise wing comprising a generally planar body having two sections forming a major surface for displacing air when moved in a direction perpendicular to the surface, a handle which is weighted to provide gravitational resistance mounted on one of the sections adapted to be grasped by the hand of the exerciser, and a loop mounted on the other section for receiving the forearm of the exerciser and holding the body substantially flat against the forearm with a portion of the body. extending above the elbow and along the upper arm of the exerciser so that movement of the arm in a direction perpendicular to the major surface is resisted by the air displaced by the body.

2. The exercise wing of claim 1 wherein the two sections are hinged together and can be folded to a superposed position for storage.

3. The exercise wing of claim 1 wherein the major surface of the body has a generally D-shaped configuration, with a straight edge along one lateral margin thereof and a curved edge along another.

4. The exercise wing of claim 3 wherein the handle and the means for holding the forearm are aligned along an axis generally parallel to the straight edge of the body.

5. An exercise wing comprising a generally planar body having two sections forming a major surface for displacing air when moved in a direction perpendicular to the surface, a handle mounted on one of the sections adapted to be grasped by the hand of the exerciser, and a loop mounted on the other section for receiving the forearm of the exerciser and holding the body substantially flat against the forearm with a portion of the body extending above the elbow and along the upper arm of the exerciser so that movement of the arm in a direction perpendicular to the major surface is resisted by the air displaced by the body, and a whistle mounted on the body for emitting an audible tone upon movement of the wing through the air.

6. An exercise wing comprising a body formed in two generally planar sections, a hinge connecting the two sections together for movement between a folded position in which the sections are superposed with major surfaces of the sections generally parallel to each other and an extended position in which the two sections are positioned side-by-side with the major surfaces aligned in coplanar fashion, means for holding the sections in the folded and extended positions, a handle mounted on one of the sections adapted to be grasped by the hand of an exerciser, and a loop mounted on the other section for receiving the forearm of the exerciser and holding the body substantially flat against the forearm, with a portion of the body extending above the elbow and along the upper arm of the exerciser.

7. The exercise wing of claim 6 wherein the means for holding the sections in the extended position comprises a lock bar pivotally mounted to one of the sections and means on the other section for engagement with the lock bar.

8. An exercise wing comprising a body formed in two generally planar sections, a hinge connecting the two sections together for movement between a folded position in which the sections are superposed with major surfaces of the sections generally parallel to each other and an extended position in which the two sections are positioned side-by-side with the major surfaces aligned in coplanar fashion, means for holding the sections in the folded and extended positions, and means including a handle which is weighted to provide gravitational resistance attached to one of the sections and adapted to be grasped by the hand of an exerciser.

9. An exercise wing comprising a body formed in two generally planar sections, a hinge connecting the two sections together for movement between a folded position in which the sections are superposed with major surfaces of the sections generally parallel to each other and an extended position in which the two sections are positioned side-by-side with the major surfaces aligned in coplanar fashion, means for holding the sections in the folded and extended positions, means carried by the sections for attaching the body to the arm of an exerciser, and means mounted on one of the sections for emitting an audible sound when the wing is moved through the air in a direction perpendicular to the major surfaces.

10. An exercise wing comprising two generally planar, sector shaped sections having first and second perpendicular side edges, an arcuate side edge and major surfaces bounded by the side edges, a hinge connecting the two sections together along the first edges for movement between a folded position in which the sections are superposed with the major surfaces of the two sections parallel to each other and an extended position in which the two sections are positioned side-by-side to form a D-shaped body with the major surfaces of the two sections aligned in coplanar fashion, means for holding the two sections in the folded and extended positions, a handle adapted to be grasped by the hand of the exerciser mounted on one of the sections, and a loop mounted on the other section for receiving the forearm of the exerciser and holding the forearm substantially flat against the body, the handle and the loop being aligned along a line parallel to the second perpendicular edges of the sections.

11. The exercise wing of claim 10 wherein the handle is weighted to provide gravitational resistance.

12. An exercise wing comprising two generally planar, sector shaped sections having first and second perpendicular side edges, an arcuate side edge and major surfaces bounded by the side edges, a hinge connecting the two sections together along the first edges for movement between a folded position in which the sections are superposed with the major surfaces of the two sections parallel to each other and an extended position in which the two sections are positioned side-by-side to form a D-shaped body with the major surfaces of the two sections aligned in coplanar fashion, means for holding the two sections in the folded and extended positions and means carried by the sections for attaching the wing to the arm of an exerciser.

13. The exercise wing of claim 12 wherein the means for holding the sections comprises a lock bar pivotally mounted to one of the sections and means on the other section for engagement with the lock bar to hold the sections in the extended position.

14. An exercise wing comprising two generally planar, sector shaped sections having first and second perpendicular side edges, an arcuate side edge and major surfaces bounded by the side edges, a hinge connecting the two sections together along the first edges for movement between a folded positioned in which the sections are superposed with the major surfaces of the two sections parallel to each other and an extended position in which the two sections are positioned side-by-side to form a D-shaped body with the major surfaces of the two sections aligned in coplanar fashion, means for holding the two sections in the folded and extended positions, means carried by the sections for attaching the wing to the arm of an exerciser, and means mounted on one of the sections for emitting an audible sound when the two sections are moved through the air in the extended position in a direction perpendicular to the major surfaces.

* * * * *